US011974672B2

(12) United States Patent
Artsiely

(10) Patent No.: US 11,974,672 B2
(45) Date of Patent: May 7, 2024

(54) COUNTERTOP INSTALLATION

(71) Applicant: CAESARSTONE LTD., Sdot Yam (IL)

(72) Inventor: Eyal Artsiely, Moshav Yafit (IL)

(73) Assignee: CAESARSTONE LTD., Sdot Yam (IL)

( * ) Notice: Subject to any disclaimer, the term of this patent is extended or adjusted under 35 U.S.C. 154(b) by 0 days.

(21) Appl. No.: 17/772,917

(22) PCT Filed: Oct. 29, 2020

(86) PCT No.: PCT/IL2020/051127
§ 371 (c)(1),
(2) Date: Apr. 28, 2022

(87) PCT Pub. No.: WO2021/084537
PCT Pub. Date: May 6, 2021

(65) Prior Publication Data

US 2022/0400862 A1 Dec. 22, 2022

Related U.S. Application Data

(63) Continuation of application No. 16/666,423, filed on Oct. 29, 2019, now Pat. No. 11,213,126.

(30) Foreign Application Priority Data

Oct. 29, 2019 (IL) ..... 270257

(51) Int. Cl.
*A47B 96/18* (2006.01)
*A47B 77/02* (2006.01)

(52) U.S. Cl.
CPC ..... *A47B 96/18* (2013.01); *A47B 77/022* (2013.01); *A47B 2077/025* (2013.01)

(58) Field of Classification Search
CPC ..... A47B 13/003; A47B 77/022; A47B 2077/025; A47B 96/18; A47B 2200/0001; A47B 2200/004
See application file for complete search history.

(56) References Cited

U.S. PATENT DOCUMENTS 3,011,849 A * 12/1961 Bishop, Jr. ..... A47B 77/022 4/619
3,101,486 A 8/1963 Tiller
(Continued)

FOREIGN PATENT DOCUMENTS

CN 110292247 A * 10/2019
CN 112137312 A * 12/2020 ..... A47B 47/00
(Continued)

*Primary Examiner* — Andrew M Roersma
(74) *Attorney, Agent, or Firm* — The Roy Gross Law Firm, LLC; Roy Gross

(57) ABSTRACT

Aspects of the present invention provide devices and methods for installation of countertops. A countertop installation device may include: a housing; a rim, extending outwards from the housing, the rim being connectable to a frame; a movable tongue arranged to move along a first axis of the shaft, and extend from the housing; and an adjustment screw configured to adjust the location of the movable tongue along a second axis. During installation of the device, the first axis may be the horizontal axis and the second axis may be the vertical axis.

7 Claims, 9 Drawing Sheets

(56) References Cited

U.S. PATENT DOCUMENTS

| | | | | |
|---|---|---|---|---|
| 5,667,327 | A * | 9/1997 | Salice | F16B 12/2009 403/231 |
| 5,743,501 | A | 4/1998 | Rapp | |
| 6,942,418 | B2 * | 9/2005 | Knauseder | A47B 87/002 403/231 |
| 7,207,636 | B2 | 4/2007 | Livingston et al. | |
| 7,429,021 | B2 | 9/2008 | Sather et al. | |
| 8,434,835 | B2 | 5/2013 | Hardy et al. | |
| 9,492,010 | B2 | 11/2016 | Booth et al. | |
| 9,990,526 | B2 | 6/2018 | Gifford et al. | |
| 10,563,387 | B1 | 2/2020 | Iocco | |
| 11,213,126 | B2 * | 1/2022 | Artsiely | A47B 77/022 |
| 2005/0073224 | A1 | 4/2005 | Livingston et al. | |
| 2008/0087778 | A1 | 4/2008 | Sather et al. | |
| 2008/0196158 | A1 | 8/2008 | Jones et al. | |
| 2009/0134287 | A1 | 5/2009 | Klosowski | |
| 2010/0090072 | A1 | 4/2010 | Jones et al. | |
| 2010/0230563 | A1 | 9/2010 | Flynn | |
| 2012/0222213 | A1 | 9/2012 | Booth et al. | |
| 2016/0097415 | A1 * | 4/2016 | Jorgensen | F16B 12/04 411/82.1 |
| 2017/0037606 | A1 | 2/2017 | Booth et al. | |
| 2018/0044901 | A1 | 2/2018 | Lloyd | |
| 2018/0180295 | A1 | 6/2018 | Kobos | |
| 2020/0229589 | A1 * | 7/2020 | Hill | A47B 96/07 |

FOREIGN PATENT DOCUMENTS

| | | | | |
|---|---|---|---|---|
| DE | 202016005283 | U1 * | 10/2016 | |
| DE | 202017102734 | U1 | 8/2018 | |
| DE | 102019106949 | A1 | 9/2020 | |
| EP | 0414659 | A1 * | 2/1991 | A47B 13/00 |
| GB | 2452586 | A * | 3/2009 | A47B 87/002 |
| JP | H-07255550 | A * | 10/1995 | A47B 96/18 |
| JP | H-08252134 | A * | 10/1996 | A47B 96/18 |
| WO | WO-2011138203 | A1 * | 11/2011 | A47B 95/00 |

* cited by examiner

COUNTERTOP INSTALLATION

This application is a National Phase of PCT Patent Application No. PCT/IL2020/051127 having International filing date of Oct. 29, 2020, which claims the benefit of priority of U.S. patent application Ser. No. 16/666,423, and Israel Patent Application No. 270257, both filed on Oct. 29, 2019 and all titled "COUNTERTOP INSTALLATION". The contents of the above applications are all incorporated by reference as if fully set forth herein in their entirety.

FIELD OF THE INVENTION

The present invention generally relates to devices and methods for installation of countertops. more particularly, the present invention relates to countertop installation devices and methods for easy installation, removal, and adjustment thereof.

BACKGROUND OF THE INVENTION

A countertop usually refers to a horizontal surface in kitchens, furniture, bathrooms, or other table surfaces. It is frequently installed on and supported by a cabinet framework. The surface of a countertop is typically positioned at an optimal height for which the countertop is designed. The surface of a countertop may be constructed of various materials with different attributes and aesthetics. For example, countertop surfaces may be natural stone or artificial stone or other materials.

Traditional countertops, both natural and artificial, are often heavy, and require professional installers for installation. For instance, for natural materials, specialized equipment is required to cut, measure, and polish the materials, such as granite. In addition, granite slabs are exceptionally heavy, and require upright-vertical positioning when not supported horizontally to prevent the slabs from cracking or breaking. And typically, at least two people are required to transport, and install the slabs as countertops. Laminate and similar countertops are heavy and awkward to maneuver. In addition, these countertops have other drawbacks. For instance, to fit and install these countertops requires special tools, and adhesives or other bonding agents. Sometimes the bonding agents emit noxious fumes, thereby requiring plenty of ventilation during the curing process. The overall process of installing laminate countertops is time consuming and labor intensive.

Another drawback is removal of a countertop for the installation of a new one is difficult; it usually involves breaking the countertop and can cause damage to the framework, wall or other kitchen items.

Another major problem in countertop installation is joining adjacent stone slabs without a visible seam. The two slabs ideally should abut against each other perfectly along the entire seam and should be at the same exact height, so the user feels and sees the slabs as one continuous stone. In real life, however, nothing is perfect. The prior art requires a major effort to level the adjoining slabs and abut them; the slabs are heavy and cumbersome, and it is a major challenge to level and adjoin them.

SUMMARY OF THE INVENTION

Aspects of the present invention provide devices and methods for installation of countertops, such as stone countertops, and particularly in which the countertop can be easily removed and a new countertop installed in place of the previous one. In all embodiments, the countertop may not be bonded to any framework or wall. In some embodiments, the countertop is affixed to a bracket such as with mechanical fasteners, but may not be affixed to the framework, thereby enabling easy removal and replacement.

Some embodiments provide a countertop levelling and adjoining device, which may be affixed to the framework and provides an easy and convenient device for joining and levelling adjacent stone slabs. which in the prior art is a major challenge.

There is thus provided in accordance with some non-limiting embodiments of the present invention a method for countertop installation including affixing a mechanical interface to at least one of a cabinet framework and a wall, and securing a countertop directly to the mechanical interface without directly attaching the countertop to the cabinet framework or the wall.

The method may further include removing the countertop from the mechanical interface and installing in its place a different countertop.

Some aspects of the invention may be directed to a countertop installation device, comprising: a housing; a rim, extending outwards from the housing, the rim being connectable to a frame; a movable tongue arranged to move along a first axis of the shaft, and extend from the housing; and an adjustment screw configured to adjust the location of the movable tongue along a second axis. In some embodiments, during installation of the device, the first axis may be the horizontal axis and the second axis may be the vertical axis.

In some embodiments, the countertop installation device may further include an adjustment unit for adjusting a location of the movable tongue along the first axis. In some embodiments, the adjustment unit may include a threaded shaft. In some embodiments, the adjustment unit may include: a shaft, a cogwheel and a cogwheel screw configured to rotate the cogwheel and the shaft.

In some embodiments, countertop installation the device may further include a slotted plate configured to be attached to a countertop, the slotted plate may include a slot configured to receive the movable tongue.

In some embodiments, countertop installation the device may further include a telescopic frame configured to mount the countertop installation device. In some embodiments, the telescopic frame may be configured to mount two or more countertop installation devices.

Some other aspects of the invention may be directed to a lateral countertop installation device, comprising: a framework bracket; and a countertop interface member coupled to the framework bracket by a flexible member. In some embodiments, the countertop interface member may be configured to be received by one of: a slot in a slotted plate and a groove in a countertop.

In some embodiments, the lateral countertop installation device may further include a slotted plate configured to be attached to a countertop, comprising a slot configured to receive the countertop interface member.

Some additional aspects of the invention may be directed to a bracket member, comprising: a wall interface member; and a wall piece support member extending perpendicularly from wall interface member, and configured to space between a countertop and a wall piece there above.

In some embodiments, the bracket member may further include a countertop support member, extending perpendicularly from wall interface member and configured to support the countertop. In some embodiments, the bracket member may further include a smoothing element located between the wall interface member and a wall.

Some additional aspects of the invention may be directed to a sink installation device, comprising: a sink wall mount member configured to be affixed to a wall of a sink; and a pusher element, arranged to move linearly in a threaded housing. In some embodiments, the threaded housing may include a mating element that mates with a receiving element on sink wall mount member.

Some additional aspects of the invention may be directed to a method for countertop installation comprising: affixing a bracket member to at least one of a cabinet framework and a wall; and securing a countertop directly to the bracket member without directly attaching the countertop to the cabinet framework or said wall.

In some embodiments, the method may further include removing the countertop from the bracket member and installing in its place a different countertop.

Some additional aspects of the invention may be directed to a method for adjusting a position of a countertop slab with respect to another countertop slab, including, affixing a countertop installation device to a cabinet framework. In some embodiments, the countertop Installation device may include a movable tongue arranged to move along a first axis, the tongue being received in a slot. In some embodiments, moving said tongue along the first axis may adjust a position of said countertop slab along the first axis. In some embodiments, the countertop installation device may include an adjustment screw arranged to move the countertop slab along a second axis perpendicular to the first axis, and adjusting a position of said countertop slab with respect to another countertop slab is done by moving the tongue and said adjustment screw to adjust the position of the countertop slab along the first and second axes, respectively. In some embodiments, the countertop installation device includes a telescopic frame which is affixed to the cabinet framework.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1B:
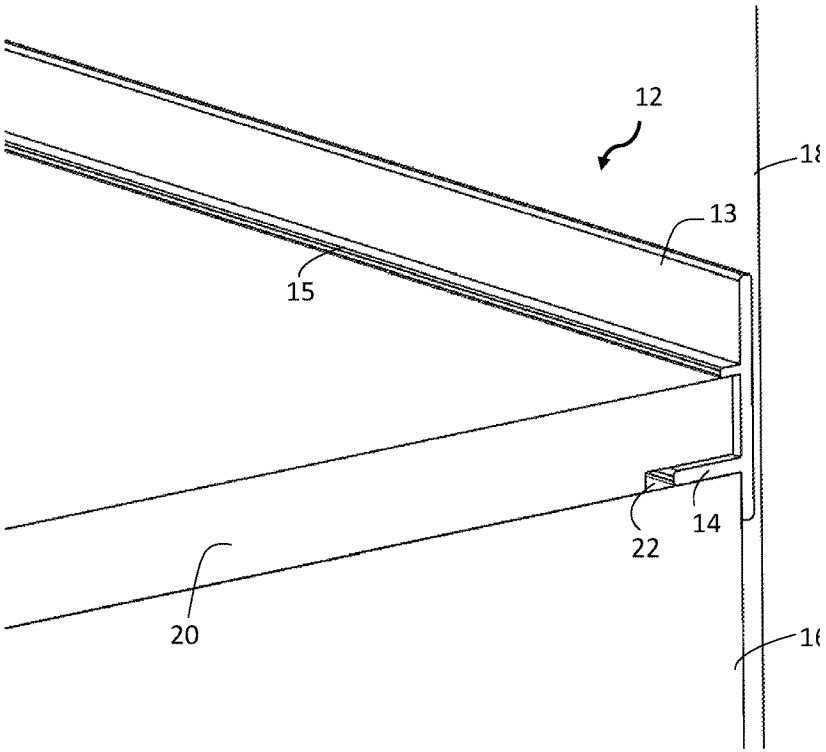
FIGS. 1A, 1B and 1C are illustrations of a countertop installation device, in accordance with a non-limiting embodiment of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DISCLOSURE OF EMBODIMENTS OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

It is noted that the terms horizontal, vertical, upper, lower and the like are relative to the drawings and are not limiting. It should be appreciated that these terms refer to directions of elements when installed or when in operation and may refer to absolute directions such as gravity so that the vertical direction is parallel to the direction of gravity, horizontal is perpendicular to gravity, and so on.

Some aspects of the invention are directed to installation devices, device, tools and methods for the installation of countertops. For example, the installation of countertops in kitchens were accurate placing of the countertop is required. In some embodiments, using installation devices according to embodiments of the invention may allow a simple assembling and a simple disassembling of the countertop to both cabinets and walls. Using such insulation devices and methods may further allow an accurate leveling and adjustment of the countertop plates with respect to the cabinets and to each other.

Figure 1A:
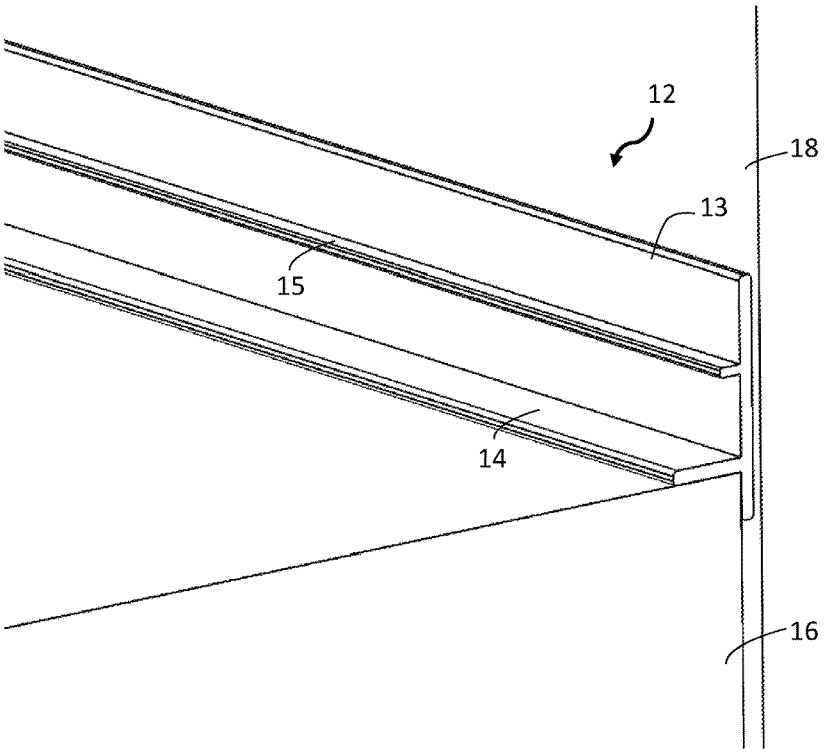
Figure 1C:
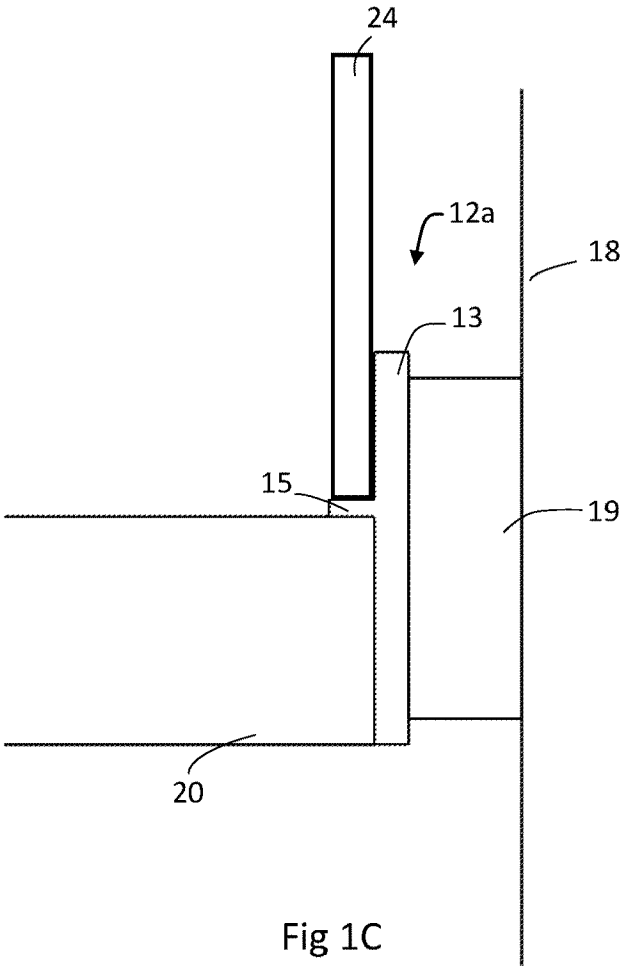

Reference is now made to FIGS. 1A, 1B and 1C, which illustrate a countertop installation device 10, in accordance with a non-limiting embodiment of the present invention.

System 10 may include a countertop 20 and a bracket member 12 which includes a wall interface member 13, and a wall piece support member 15, extending perpendicularly from wall interface member 13. In some embodiments, when bracket member 12 is assembled wall piece support member 15 may be located above countertop 20. In some embodiments, bracket member 12 may further include a countertop support member 14. A nonlimiting example for bracket member having only a wall interface member and a wall piece support member is illustrated in FIG. 1C. The countertop support member 14 may support countertop 20 and may further be spaced from wall piece support member 15 to allow insertion of countertop 20 between wall piece support member 15 and countertop support member 14. According to some embodiments, countertop support member 14 may protrude further out from wall interface member 13 than wall piece support member 15. Countertop support member 14 may not protrude from the end of wall interface member 13; instead a portion of wall interface member 13 may extend beyond (below) countertop support member 14.

In FIG. 1A, bracket member 12 may be secured to cabinet framework 16 and/or to a wall 18 (e.g., with fasteners such as screws). In FIG. 1B, countertop 20 is installed on bracket member 12. Countertop 20 may be natural such as granite, quartz, onyx, marble, sandstone, bluestone, limestone and other natural materials, or artificial, such as, concrete, laminate, acrylic or other manmade materials with various colors and patterns. Countertop 20 may be formed with an undercut surface 22 along its edge for the length of countertop support member 14. Thus, the undercut surface 22 rests on countertop support member 14. The space between countertop support member 14 and wall piece support member 15 is designed to accommodate the thickness of countertop 20. A non-adhesive sealant, such as RTV or other suitable material may be used to seal countertop 20 with respect to bracket member 12.

FIG. 1C is an illustration of bracket member 12*a* according to some embodiments. Bracket member 12*a* may include a wall interface member 13, and a wall piece support member 15, that extends perpendicularly from wall interface member 13. Bracket member 12*a* may not include a countertop support member, such as countertop support member 14 in FIG. 1A, and thus using bracket member 12*a* may not require forming an undercut (such as undercut 22) in countertop 20. In some embodiments, a wall piece 24 may be installed to wall 18 above countertop 20, such as with RTV or other suitable material, as before. Wall piece 24 may rest on wall piece support member 15. In some embodiments, wall interface member 13 may further include a smoothing member 19 on a face of interface member 13 opposite to the face from which wall piece support member 15 protrudes so that when bracket member 12 is installed, smoothing member 19 may be positioned between wall interface member 13 and wall 18. Spacer 19 may be made from any material suitable for smoothing or evening wall 18 surface.

Reference is now made to FIGS. 2A, 2B, 2C, 2D and 2E, which illustrate countertop installation devices 30 and 30*a*, in accordance with another non-limiting embodiment of the present invention. Devices 30 and 30*a* may be useful for levelling and adjoining adjacent countertop portions.

Figure 2A:
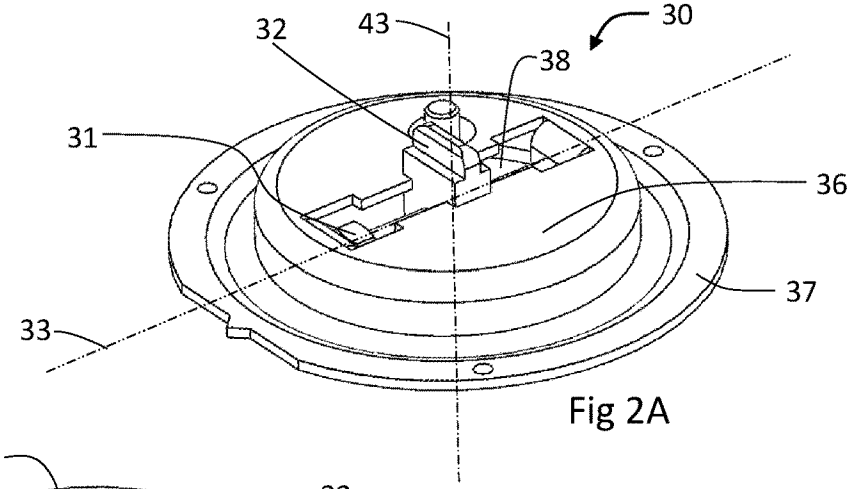
FIGS. 2A, 2B, 2C, 2D and 2E are illustrations of a countertop installation device, in accordance with another non-limiting embodiment of the present invention.
Figure 2B:
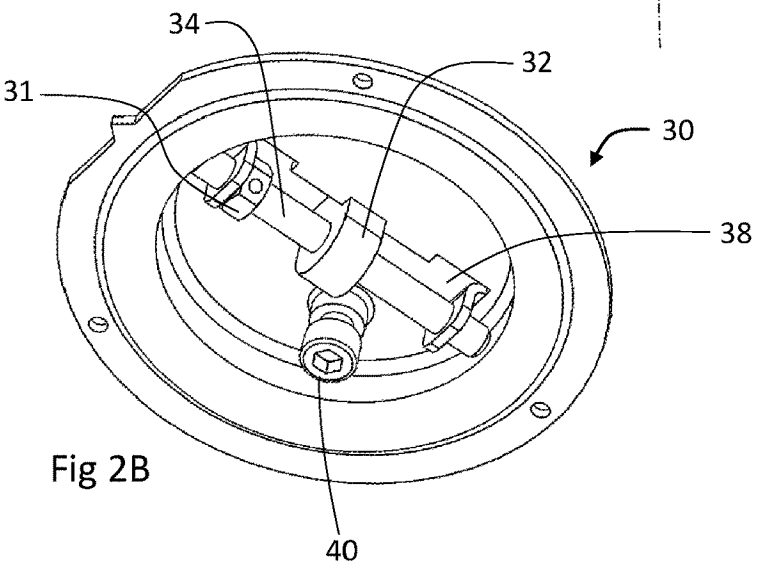

FIGS. 2A and 2B are top view and bottom view of countertop installation device 30, that may include a movable tongue 32 which may be arranged to move along a first axis 33. Countertop installation device 30 may include an adjustment unit 31 for adjusting the location of movable tongue 32 along first axis 33. For example, as seen in FIG. 2B, tongue 32 may be mounted on a threaded shaft 34, included in adjustment unit 31, which may be secured to an underside of a housing 36. Tongue 32 may protrude through a cutout 38 formed in housing 36. A rim 37 may extend outwards from housing 36. In some embodiments, first axis 33 may be parallel to rotation axis of shaft 34. An adjustment screw 40 (FIG. 2B) may be provided, such as on the underside of housing 36. Adjustment screw 40 may be configured to adjust the location of movable tongue 32 along a second axis 43. In some embodiments, during installation of the device, first axis 33*v* may be the horizontal axis and second axis 34 may be the vertical axis.

Figure 2D:
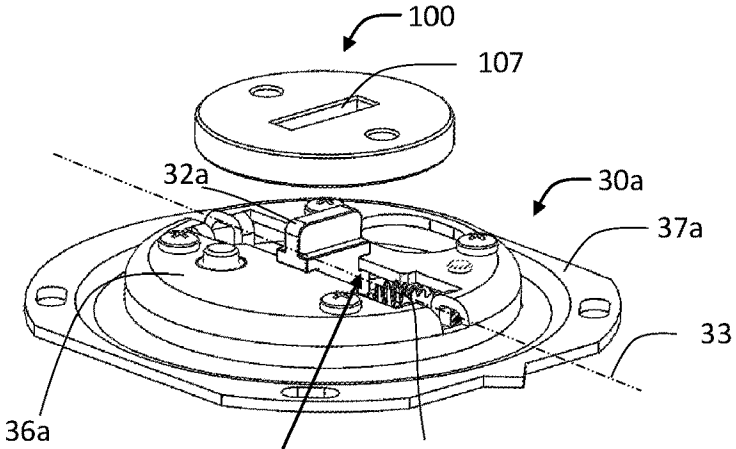
Figure 2C:
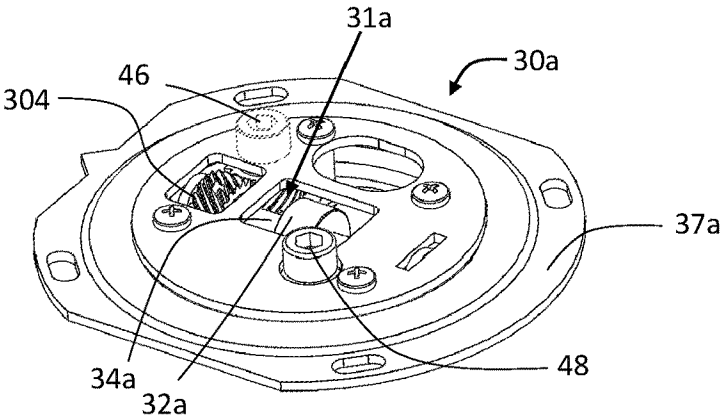

FIGS. 2C and 2D are top views of the bottom and upper sides of countertop installation device 30*a*, that may include a movable tongue 32*a* which may be arranged to move along a first axis 33 parallel to the rotational axis of a shaft 34*a*. For example, tongue 32 may be mounted on an adjustment unit 31*a* arranged to move movable tongue 32*a*. Adjustment unit 31*a* may include a shaft 34*a*, a cogwheel 304 and a cogwheel screw 46 configured to rotate cogwheel 304 and shaft 34*a*. Turning cogwheel screw 46 may rotate cogwheel 304 thus may cause shaft 34*a* to move movable tongue 32*a* along axis 33.

In some embodiments, in order to avoid the need to form slot 44 in countertop 20 for receiving movable tongue 32*a* (or movable tongue 32), device 30*a* (or device 30) may further include at least one slotted plate 100. Slotted plate 100 may be attached (e.g., screwed, glued, sticked) to the underside of countertop 20, during the installation. Slotted plate 100 may include a slot 107 for receiving movable tongue 32*a* (or movable tongue 32). Accordingly, during the installation of countertop 20 both the locations of movable tongue 32*a* and slotted plate 100 can be adjusted to achieve an optimal adjoining of neighboring countertop portions. Detailed disclosure discussing the structure and installation of slotted plate 100 is given hereinbelow with respect to FIGS. 4C and 6A-6D.

Figure 2E:
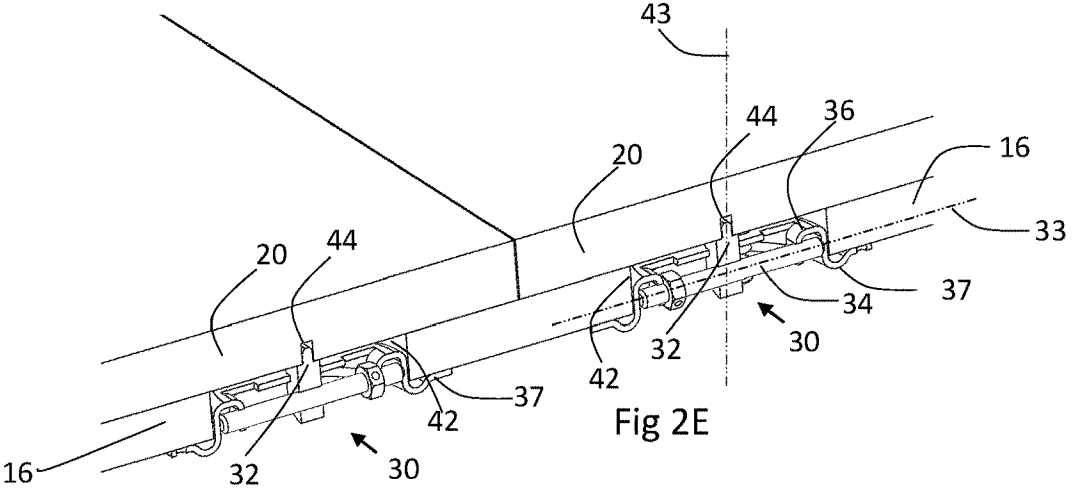

As seen in FIG. 2E, countertop installation device 30 may be installed in a groove 42 formed in the underside of framework 16. In some embodiments, countertop installation device 30*a* (not illustrated) may also be installed in a groove 42 formed in the underside of framework 16. Housing 36 or 36*a* (not illustrated) may fit in groove 42 and rim 37 or 37*a* (not illustrated) may be fastened to the underside of framework 16. Countertop 20 may be formed with a slot 44 configured to receive tongue 32. Alternatively, a slotted plat 100 may be attached to the underside of countertop 20. For example, turning threaded shaft 34 may adjust the horizontal position of tongue 32 in slot 44, which may adjust the adjoining of neighboring countertop portions. In other words, when tongue 32 is placed within slot 44 in countertop 20 (or the slot in plate 100, not illustrated), adjusting the horizontal position of tongue 32 may move countertop 20 in the same direction and may allow adjoining of adjacent countertop portions.

Turning adjustment screw 40 or 48 (illustrated in FIGS. 2B and 2C respectively) may push the end of the screw against the underside of the countertop portion and may adjust the vertical position of the countertop portion. In this manner, each adjacent countertop portion may be levelled easily by adjusting the height of screw 40 or 48 against the countertop portion and adjoined by adjusting the horizontal position of tongue 32 to achieve a seamless joint.

Figure 3B:
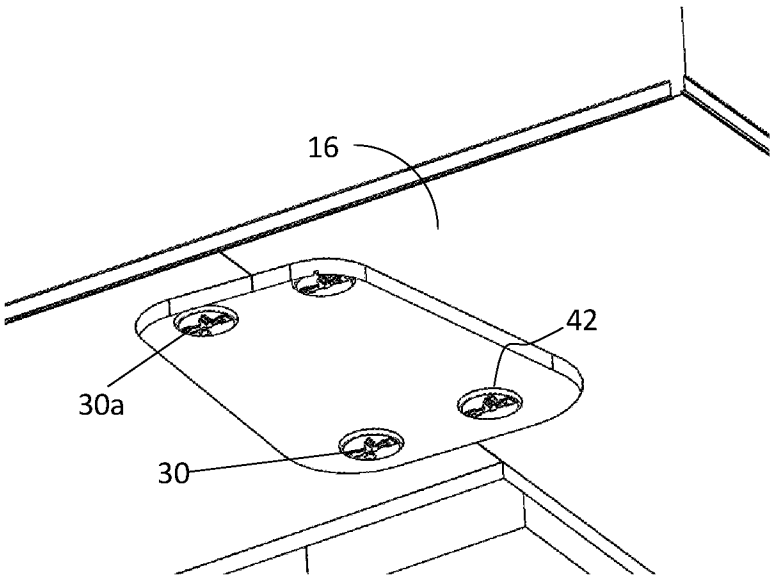
FIGS. 3A, and 3B are illustrations of installation of the countertop with the embodiments of FIGS. 2A-2E, FIGS. 4A, 4B and 4C are illustrations of a countertop installation device, in accordance with another non-limiting embodiment of the present invention.
Figure 3A:
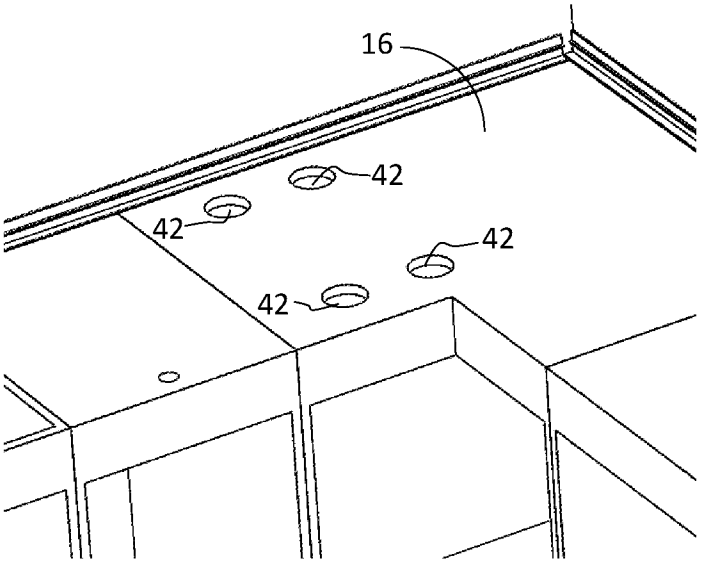

Reference is further made to FIGS. 3A, and 3B, which are illustrations of installation of countertop 20 with the countertop installation devices 30 or 30*a*. In FIG. 3A, grooves 42 are prepared in the framework 16 to accept the mechanical fasteners (countertop installation devices 30 or 30*a*). In FIG. 3B, countertop 20 may be placed on the framework 16 As seen from underneath framework 16, countertop installation devices 30 or 30*a* may have been placed in the holes 42. In some embodiments, each installation devices 30 or 30*a* may be thus affixed to framework 16 and is easily accessible to achieve the seamless adjoining. In some embodiments, countertop 20 may include slots 44 for receiving movable tongue 32 or 32*a*. In some embodiments, slotted plates 100 may be attached to the underside of countertop 20, thus replacing the need of forming slots 44 prior to the assembling of countertop 20.

Figure 4C:
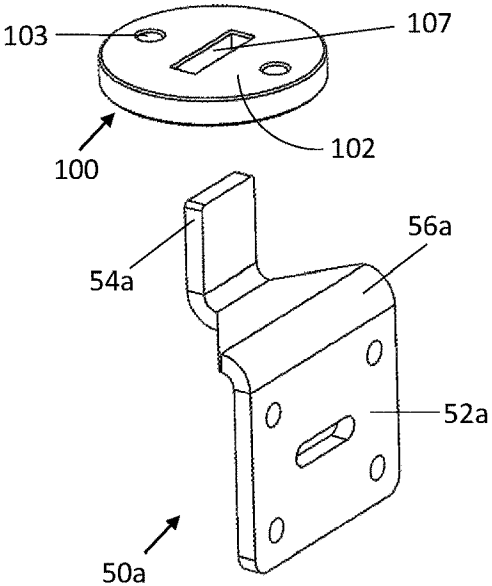
Figure 4B:
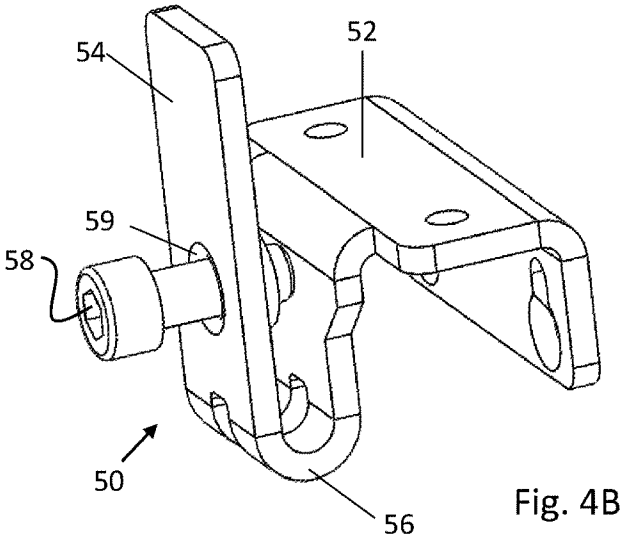
Figure 4A:
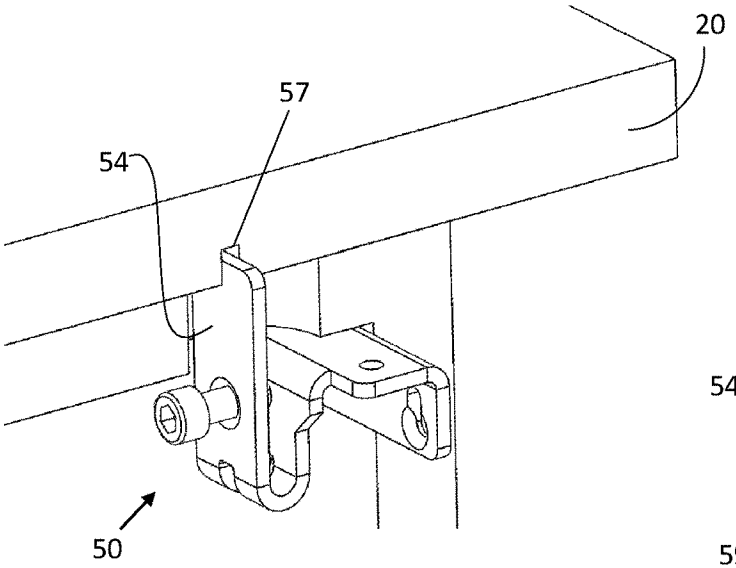

Reference is now made to FIGS. 4A, 4B and 4C, which illustrate lateral countertop installation devices 50 and 50*a*, in accordance with another non-limiting embodiment of the present invention.

As seen in FIG. 4A, countertop 20 may be formed with a groove 57 into which is received countertop interface member 54. Tightening adjustment screw 58 against framework bracket 52 may presses countertop interface member 54 against groove 57 and affixes countertop 20 in place. The fastener can be used for cabinets with or without horizontal support.

As seen in FIG. 4B, lateral countertop installation device 50 may include a framework bracket 52 and a countertop interface member 54 coupled to framework bracket 52 by a flexible member 56, such as a U-shaped resilient member. An adjustment screw 58 may be coupled to countertop interface member 54, such as by threaded engagement with a threaded hole 59. The adjustment screw 58 may abut against a portion of framework bracket 52. Movement of adjustment screw 58 against framework bracket 52 may cause countertop interface member 54 to move further away from framework bracket 52, and vise versa, as seen in FIG. 4B.

In some embodiments, in order to avoid the need to form groove 57 in the underside of countertop 20, slotted plate 100 may be added to lateral countertop installation devices 50 or 50*a*, as illustrated in FIG. 4C. Slotted plate 100 may include a base 102 slotted with slot 107 for receiving countertop interface member 54 or countertop interface member 54*a* of device 50*a* (or a movable tongue as discussed herein above). Slotted plate 100 may further include attachment means for attaching (e.g., screwing, gluing, sticking, etc.) slotted plate 100 to the underside countertop 20, for example, the illustrated holes 103.

As should be understood by one skilled in the art, rounded base 102 of plate 100 illustrated in FIGS. 2D and 4C is given as an example only, and base 102 may have any geometric shape, such as a rectangle, a triangle, an arrow and the like.

As further seen in FIG. 4C device 50*a* may include a countertop interface member 54*a* coupled to framework bracket 52*a* by a flexible member 56*a*. In such an arrangement, not other elements are required and framework bracket 52*a* is fixated to a framework (e.g., formwork 16) by, for example, by screws, such that countertop interface member 54*a* may be received in slot 107 or grove 57.

In some embodiments, slotted plate 100 may also be included in device 50 (not illustrated). In such case, slotted plate 100 may be attached to the underside of countertop 20 and countertop interface member 54 may be inserted into slot 107. Tightening adjustment screw 58 against framework bracket 52 may presses countertop interface member 54 against slot 107 and affixes countertop 20 in place. The fastener can be used for cabinets with or without horizontal support.

Figures 5A, 5B, 5C:
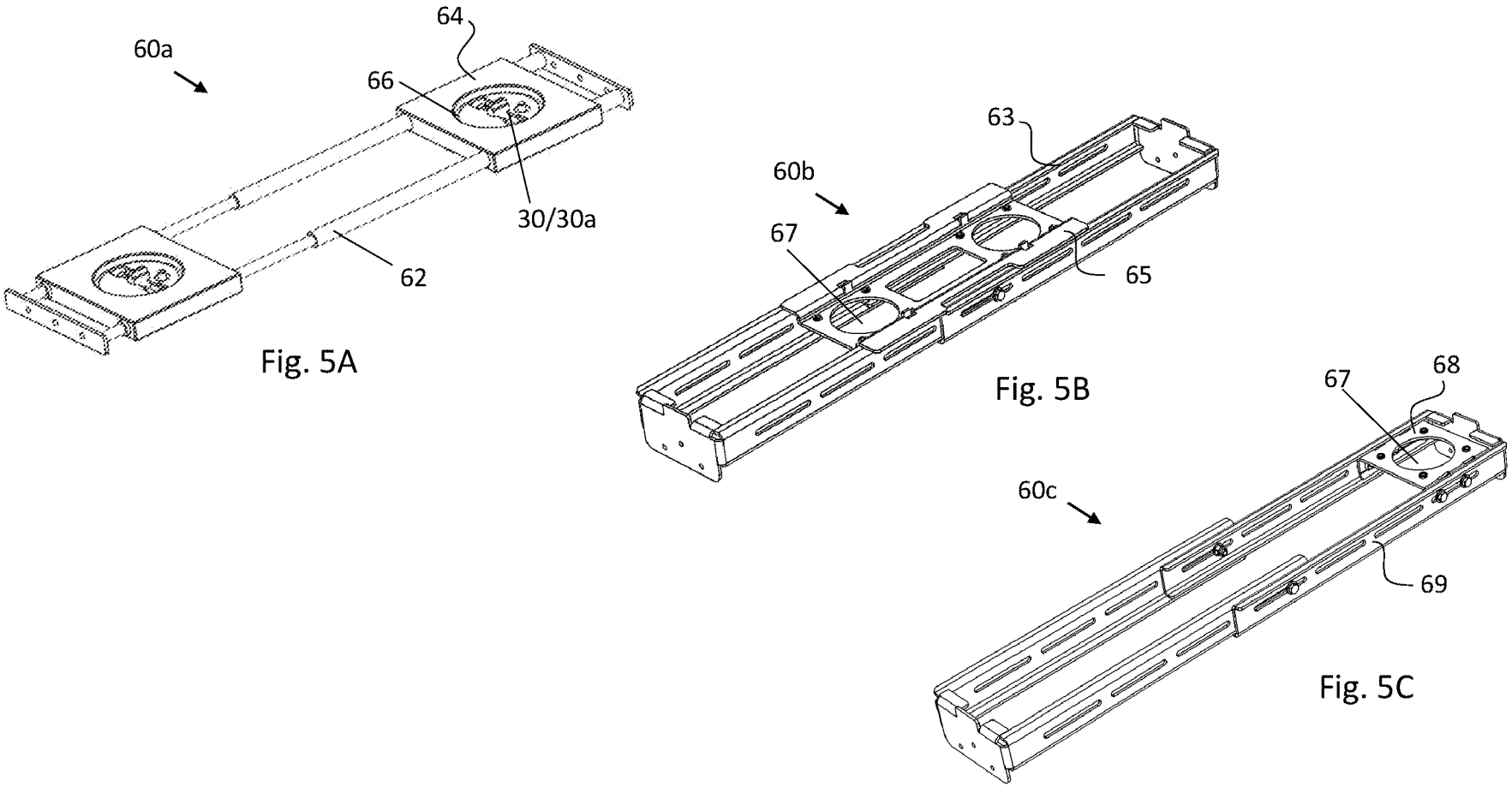
FIGS. 5A, 5B and 5C are illustrations of telescopic frames for mounting the mechanical fasteners of FIGS. 2A-2E thereon, according to some non-limiting embodiments.

Reference is now made to FIGS. 5A, 5B and 5C. Sometimes, no horizontal cabinet framework is available to attach or mount the countertop installation devices. In some embodiments, countertop installation devices 30 or 30 a may include a telescopic frame 60*a*, 60*b* and/or 60*c* for mounting countertop installation devices 30 or 30*a* of FIGS. 2A-2D thereon (or any other countertop installation device of the invention). As seen in FIG. 6A, telescopic frame 60*a* may include telescopic bars 62 which can be adjusted (that is, lengthen or shorten the overall length of the bars) to suit any installation requirement. Telescopic frame 60*a* may further include one or more housings 64 mounted to telescopic bars 62 and configured to move along the longitudinal axis of telescopic frame 60*a*. Each housing 64 may include an opening 66 for accommodating and holding countertop installation devices 30 or 30*a*. Therefore, the position of installation device 30 or 30*a* may be adjusted when adjoining neighboring countertop slabs.

Figure 6C:
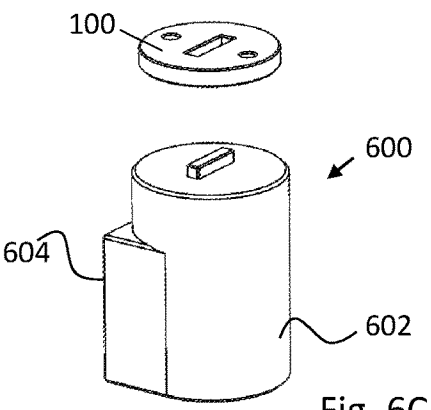
FIGS. 6A, 6B, 6C and 6D are illustrations of tools for placing slotted plates for countertop installation devices, in accordance with some non-limiting embodiments of the present invention.
Figure 6D:
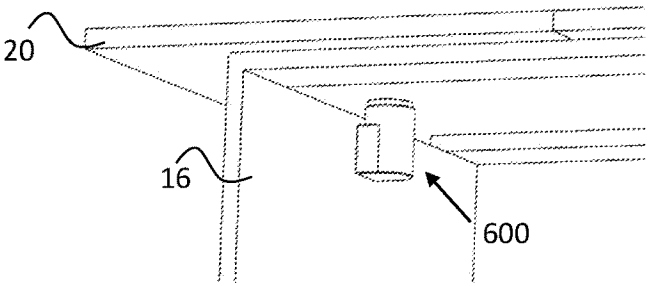
Figure 6A:
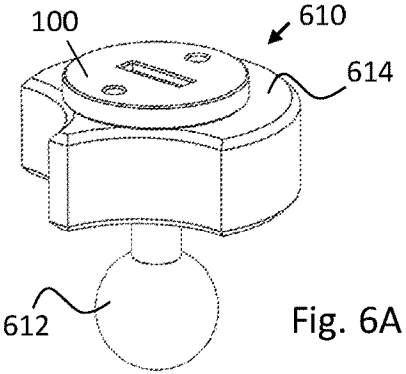
Figure 6B:
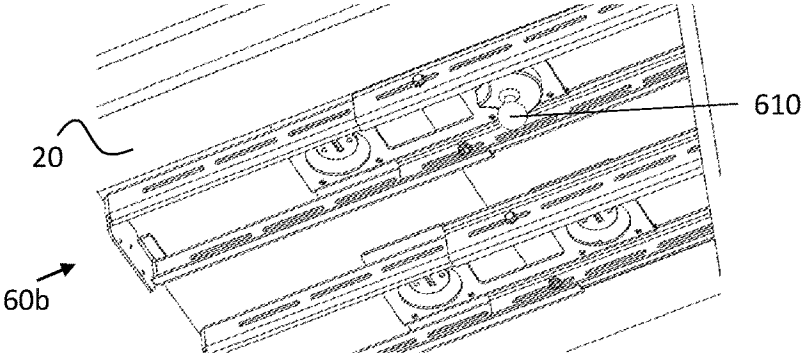

Similar arrangement can be achieved using slidable farms 63 and 69 of telescopic frame 60*b* and 60*c*, illustrated in FIGS. 6B and 6C respectively. Telescopic frame 60*b* may further include two or more housings 65, mounted to slidable farm 63, each having an opening 67 for accommodating and holding countertop installation devices 30 or 30*a*. Telescopic frame 60*c* may include a single housings 68, mounted to slidable farm 69 having an opening 67 as in telescopic frame 60*b*. Housing 65 and 68 may be configured to move along the longitudinal axis of telescopic frame 60*d* and 60*c* respectively.

Reference is now made to FIGS. 6A, 6B, 6C and 6D which are illustration of tools for placing slotted plate 100 in a framework according to some embodiments of the invention. Tools 600 and 610 may allow an accurate attachment of slotted plate 100 to the underside of countertop 20.

As seen in FIGS. 6A and 6B, tool 610 may be used for placing slotted plate 100 with respect to telescopic frame 60*a*, 60*b* or 60*c*. Tool 610 may include a holder 614 for holding slotted plate 100 and a handle 612 to be held by a user placing slotted plate 100.

As seen in FIGS. 6C and 6D, tool 600 may be used for placing slotted plate 100 with respect to a wall of cabinet framework 16, such that a substantially right angle may be kept between base 102 of plate 100 and the wall. Tool 600 may include a holder 602 for holding plate 100 and a placer 604 for ensuring the right angle between base 102 of plate 100 and the wall of framework 16.

Figure 7C:
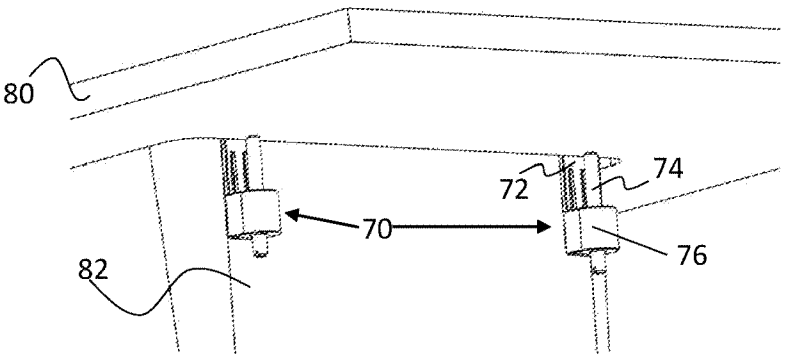
FIGS. 7A, 7B, 7C and 7D are illustrations of countertop installation devices, in accordance with another non-limiting embodiment of the present invention.
Figure 7B:
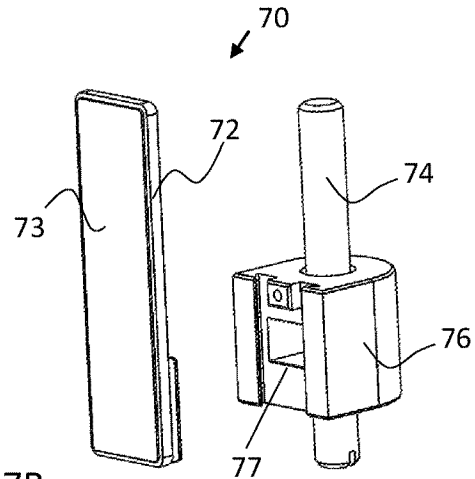
Figure 7A:
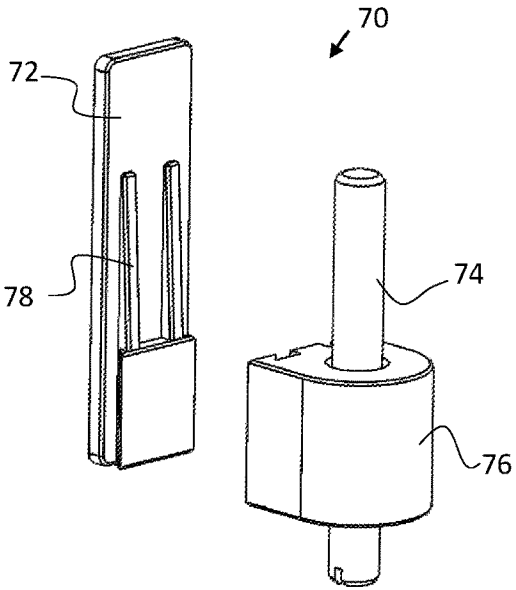

Reference is now made to FIGS. 7A, 7B and 7C, which illustrate a sink installation device 70.

As seen in FIGS. 7A and 7B, sink installation device 70 may include a sink wall mount member 72, which may be affixed to a wall of a sink 82 such as by means of an adhesive backing 73. Sink installation device 70 may include a pusher element 74, such as a threaded rod that is arranged to move linearly in a threaded housing 76. Housing 76 may include a mating element 77 that mates with a receiving element 78 on wall mount member 72.

Figure 7D:
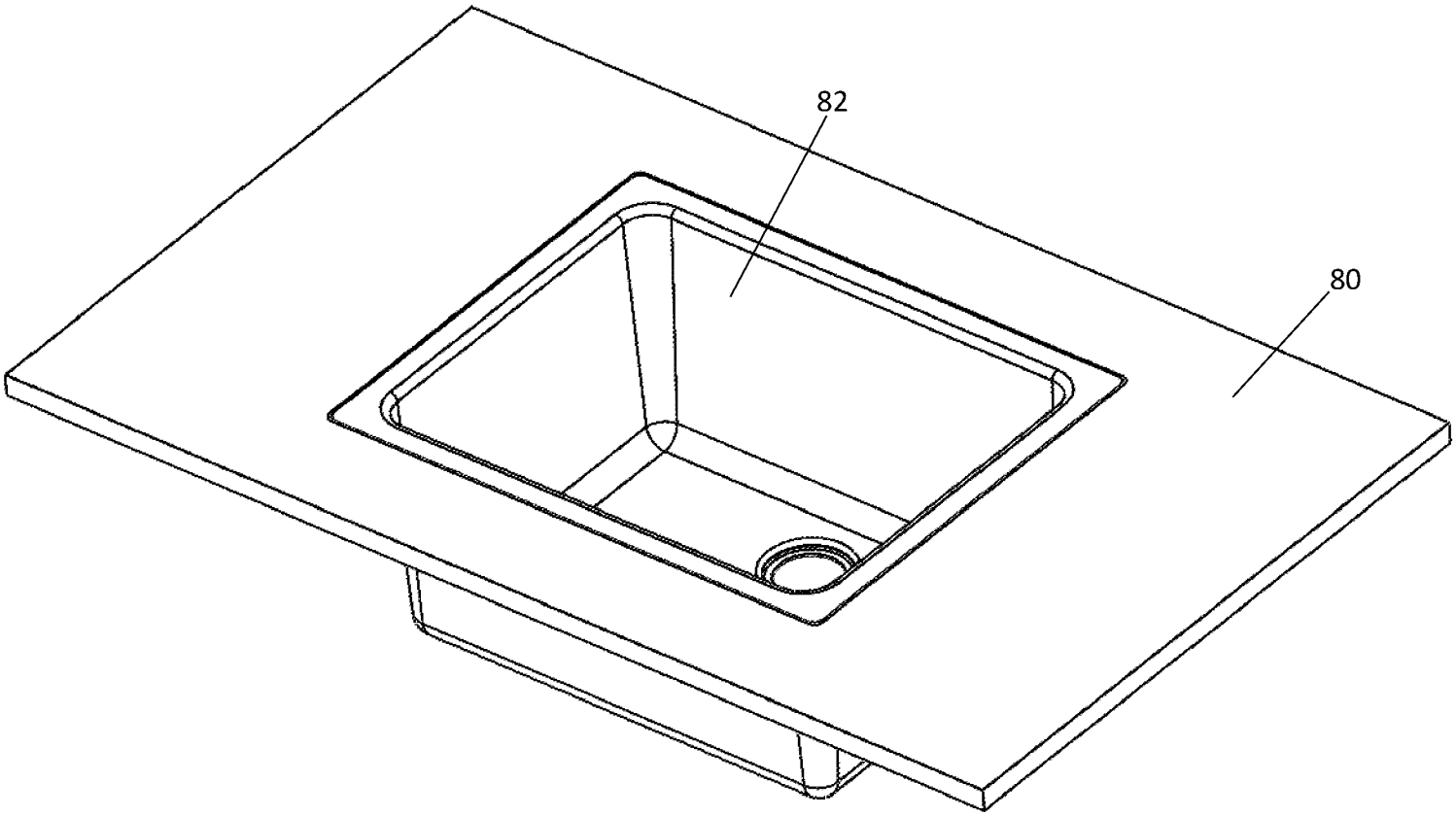

FIG. 7C illustrates sink installation device 70 mounted on the wall of sink 82 underneath a countertop 80. The sink wall mount member 72 may be mounted to the wall of sink 82. The mating element of housing 76 may be received in receiving element 78 of sink wall mount member 72. The pusher element 74 may be moved so that it abuts against the underside of countertop 80. As seen in FIG. 7D, a rim of sink 82 may rest upon countertop 80. The pusher element 74 may press the underside of countertop 80 against this rim to secure sink 82 in place.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A countertop installation device, comprising:

a housing;

a rim, extending outwards from the housing, the rim being connectable to a frame;

a tongue adjustment unit adjusting a location of a movable tongue along a horizontal axis during installation, the movable tongue extends from the housing; and an adjustment screw configured to adjust a location of a countertop along a vertical axis during installation, wherein the tongue adjustment unit comprises a shaft and two cogwheels.

2. The countertop installation device of claim 1, wherein the tongue adjustment unit comprises a threaded shaft.

3. The countertop installation device of claim 1, further comprising a slotted plate configured to be attached to a countertop, the slotted plate comprising a slot configured to receive the movable tongue.

4. The countertop installation device of claim 1, further comprising a telescopic frame configured to mount the countertop installation device.

5. The countertop installation device of claim 4, wherein the telescopic frame is configured to mount two or more countertop installation devices.

6. A method for adjusting a position of a countertop slab, comprising:

affixing a countertop installation device to a cabinet framework, wherein the countertop installation device comprises:

a tongue adjustment unit adjusting a location of a movable tongue along a horizontal axis, the tongue being received in a slot, an adjustment screw configured to adjust a location of a countertop along a vertical axis;

moving said tongue along the horizontal axis to adjust a horizontal position of said countertop slab; and adjusting a vertical position of said countertop slab by adjusting said adjustment screw, wherein the tongue adjustment unit comprises a shaft and two cogwheels.

7. The method according to claim 6, wherein the countertop installation device includes a telescopic frame which is affixed to the cabinet framework.

* * * * *